United States Patent [19]

Gloystein

[11] Patent Number: 4,497,271

[45] Date of Patent: Feb. 5, 1985

[54] STOWING STRUT FOR MAKING FAST CONTAINERS OR THE LIKE

[75] Inventor: Jürgen Gloystein, Osterholz-Scharmbeck, Fed. Rep. of Germany

[73] Assignee: Conver Ing. - Technik GmbH & Co., KG, Fed. Rep. of Germany

[21] Appl. No.: 430,150

[22] Filed: Sep. 30, 1982

[30] Foreign Application Priority Data

Jan. 15, 1982 [DE] Fed. Rep. of Germany ..... 3201012

[51] Int. Cl.[3] ..... B63B 25/24

[52] U.S. Cl. ..... 114/75; 410/77; 410/85

[58] Field of Search ..... 114/72, 75; 410/68, 410/77, 78, 79–86; 403/381

[56] References Cited

U.S. PATENT DOCUMENTS

| | | | |
|---|---|---|---|
| 3,481,298 | 12/1969 | Dluhy | 114/72 |
| 3,722,714 | 3/1973 | Morris et al. | 410/85 |
| 3,776,169 | 12/1973 | Strecker | 410/77 |
| 4,019,298 | 4/1977 | Johnson | 403/381 |

FOREIGN PATENT DOCUMENTS 2121947 11/1971 Fed. Rep. of Germany .

OTHER PUBLICATIONS

"Moderne Container-Zurr-und Stausysteme an Deck von Containerschiffen" by J. Gloystein, HANSA, Schiffahrt, Schiffbau, Hafen 117, Jahrgang 1960 Nr. 22, pp. 1749–1753.

"MS Papagena—ein neus Mehrzweckcontainer Typ MBC" by Fred Carratek et al., Seewirtschaft 13 a '931, pp. 83 to 88.

*Primary Examiner*—Sherman D. Basinger

*Attorney, Agent, or Firm*—Sughrue, Mion, Zinn, Macpeak and Seas

[57] ABSTRACT

The stack of containers, assembled from individual containers in a ship's hold, must, in order to secure the loading position, be connected to the ship's structure by suitable stowing struts, which must be amenable to length-alteration in order to permit adaptation to a prevailing loading position. A stowing strut is proposed for this purpose, this strut being provided, according to the invention, with an adjustable coupling (11). This coupling comprises two coupling-halves (coupling plate 23, cone-piece 24) and possesses, in each case, tooth-systems (28, 31) which enable a positively-locked connection to be produced between the coupling plate (23) and the cone-piece (24), in various relative positions of these parts.

8 Claims, 4 Drawing Figures

STOWING STRUT FOR MAKING FAST CONTAINERS OR THE LIKE

DESCRIPTION

The invention relates to a stowing strut for making fast containers, or the like, aboard a ship, with connecting elements located at the ends, for connection, on the one hand, to at least one container corner-fitting of a container and, on the other hand, to part of the ship's structure, and with a device for altering the effective length.

Large-capacity containers are being increasingly employed for the transportation of the most diverse types of goods. For transportation on ships, individual containers are packed together to form a container-stack, the individual containers being connected one to another, in each case, by means of suitable connecting means. During transportation, considerable movements of the ship occur, due to the waves, above all in the case of oceangoing ships, these movements subjecting the container-stack to considerable loads. At the same time, it is essential, in particular, to prevent the container-stack from moving inside the ship. Any change in the position of the container-stack would immediately lead to a change in the ship's trim, which would result in a reduction in the ship's stability and maneuverability which would imply a considerable safety hazard.

For this reason, it is absolutely necessary to secure the container-stack aboard the ship. Stowing struts are used for this purpose, which connect the container stack to the ship in order to render the stack positionally secure. For this purpose, one end of the stowing strut is attached to part of the ship's sturcture, in the hold, for example to one of the ship's sides, while the second end possesses cones which engage into the standardized corner-fittings of the containers. In order to do this, these cones must assume a precise position relative to the container corner-fittings, but this position varies slightly in the case of each loading operation. The stowing struts must accordingly be designed to be length-adjustable, in such a manner that they can be adapted to the particular loading position of the container-stack.

Known stowing struts are accordingly designed in two parts, and are connected by means of a threaded spindle. In such designs, one half of the spindle, and of the stowing piece, is provided with a left-hand thread, while the other half of the stowing piece, and of the spindle, possesses a right-hand thread. By rotating the spindle, the distance between the two halves of the stowing strut can consequently be shortened or extended, as desired.

This solution leads not only to comparatively high manufacturing costs, but also leads to handling difficulties when used under shipboard conditions, which are generally known to be arduous. These difficulties can occur, for example, as a result of damage to the threads, and/or bending of the threaded spindle, caused by mechanical stressing, as a result of which adequate adjustability is no longer guaranteed. In addition, this adjustability is further impaired by the corrosion which occurs in the coarse of time. Moreover, the threaded spindle represents a component on which repairs can be carried out only with difficulty, leading to a possible spare-part procurement involving high costs.

The object underlying the invention is to propose a stowing strut which is inexpensive and makes it possible to carry out the length-alteration in a simple manner, which is both functionally reliable and permanent.

In order to achieve this object, the stowing strut, according to the invention, comprises an adjustable coupling possessing a plurality of coupling parts, especially two mutaully displaceable coupling-parts (cone-piece and coupling plate, respectively), on which parts profile-features, especially tooth-systems, are arranged, these features fitting (correspohdingly) with each other, in each case, and being in mutual engagement, as the result of positive locking, in the region of the profile-features.

The adjustable coupling of the stowing strut, according to the invention, enables the strut-length to be adjusted in a simple manner. Tooth-systems are employed for this purpose, which are arranged on the two coupling parts of the adjustable coupling, namely on a cone-piece and on a coupling plate. For this purpose, the cone-piece is preferably provided with a cone, which serves to engage into two container corner-fittings, and is connected to a plate, which is toothed on two opposite sides. The coupling plate is composed of a plate which is provided with a rectangular cutout, this cutout likewise possessing tooth-systems, of the same type, in its two opposite, longer sides. The (elongate) cutout in the coupling plate receives the cone-piece at a point which can be determined in advance, in such a manner that a portion of the longer tooth-system of the cutout produces a positively-locked connection with the tooth-system of the cone-piece. By this means, the distance of the cone from a wedge-guide, which is located on the coupling plate, can be altered as required. The basal surfaces of the two plates, which are both approximately equally thick and are located on the cone-piece, and on the coupling plate, serve as bearing surfaces at the container corner-fittings. In the case of superimposed containers, these plates are located between the corner-fittings, whereby the position of the cone-piece is fixed at the intended point within the cutout in the coupling plate. This leads to the forced securing of the adjustable coupling against being unintentionally released and unintentionally adjusted.

The tooth-systems on the wedge-piece and on the cone-piece are formed by projections and indentations having an approximately semicircular cross-section, which are arranged in alternation, one behind another. This arrangement results in a comparatively simple toothing-profile, which has a comparatively large pitch, is economical to manufacture and, in addition to being very stable, is not susceptible to damage. Since the dimensions of the indentations are slightly larger than those of the projections, there is sufficient play between the tooth-systems of the coupling plate and of the cone-piece to enable these parts to continue to mesh freely with each other even when they have been slightly damaged or are corroded.

The tooth-systems are, in each case, arranged opposite each other in such a manner that the projections and indentations are located directly opposite one another.

An arrangement of the tooth-systems, of this type, enables the cone-piece to be brought into connection with the coupling plate, relative to all mid-planes, by turning the cone-piece over.

The out-of-center location, in the longitudinal direction, of the cone in the cone-piece plate has the result that the two lateral surfaces of the cone, extending transversly to the longitudinal mid-plane, are aligned with different profile-sections of the tooth-system which is arranged on the cone-piece. One lateral surface of the cone is preferably in alignment with two oppositely-located indentations of the tooth-system, while the other lateral surface of the cone is in alignment with oppositely-located raised features of the tooth-system. An arrangement of this type enables the adjustment-steps of the cone-piece, in the cutout in the coupling plate, which are produced as a result of the comparatively coarse toothing, to be reduced to a range which corresponds to half the pitch of the tooth-system, in that the cone-piece is inserted, into the cutout, in a position which has been rotated through 180° relative to the horizontal plane. In addition, the out-of-center arrangement of the cone permits it, by appropriately rotating the cone-piece, to be moved closer to the end regions of the cutout, the result being a larger effective adjustment-travel of the adjustable coupling.

The stowing strut, according to the invention, can be composed of the adjustable coupling and a connecting tube, these components possessing an appropriate coupling device (wedge-guide, wedge-piece).

The vertical guide surfaces of the wedge-guide on the connecting tube are designed to be considerably longer than the guide surfaces of the wedge-piece of the adjustable coupling, which are in engagement therewith, as a result of which the adjustable coupling and the connecting tube can be coupled together in such a manner that the horizontal mid-plane of the adjustable coupling can be adjusted, vertically, relative to the horizontal mid-plane of the connecting tube. Appropriate positional security is provided by means of a chain, which is attached to the adjustable coupling, and which can be fastened to the connecting tube by means of a suitable connecting element, such as, for example, a snap hook.

A stowing strut, assembled in this manner from a plurality of parts, offers the advantages that the individual parts can easily be handled, and constitute little hindrance when out of use.

In addition, when a stowing strut is designed in this manner, it is possible, during the unloading operation, to remove only the adjustable coupling, while the connecting tube can remain in its on-board mounting.

In the text below, an illustrative embodiment of the invention is explained in more detail by reference to the drawing, in which.

Figure 1:
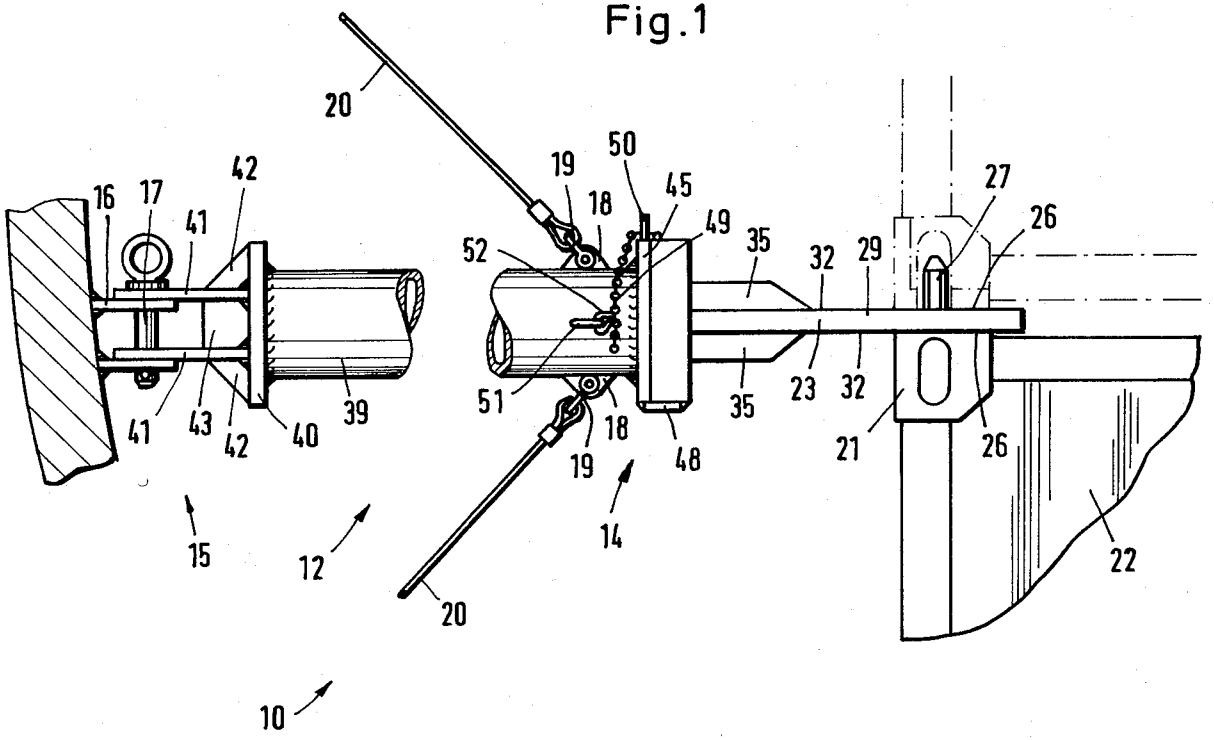
FIG. 1 shows a lengthwise view of a stowing strut in the installed condition.

The illustrative embodiment represented relates to a stowing strut 10, which is assembled from an adjustable coupling 11 and a connecting tube 12. These components can be coupled together by means of a wedge-guide 14, which is located at one end of the connecting tube 12, and a wedge-piece 13, which is located on the adjustable coupling 11. A chain 49, which is attached, at one end, to a coupling plate 23 of the adjustable coupling 11, serves to positionally secure the wedge-piece 13 in the wedge-guide 14. For this purpose, one end of the chain 49 is led through a holding-eye 50 on the top of the wedge-guide 14, and is fastened to an attachment-eye 51 on the connecting tube 12 by means of a snap hook 52 which is attached to the chain 49 at an appropriate point.

The stowing strut 10, assembled in this manner, is provided with a fork-piece 15, at the end of the connecting tube 12 opposite to the wedge-guide 14. This fork-piece serves to attach the stowing strut 10 to a holding fixture 16, by means of two socket-pins 17. The holding fixture 16 is conventionally installed on a suitable wall of the ship's hold.

In the vicinity of that end of the connecting tube 12 which is pointed towards the wedge-guide 14, two cable-eyes 18 are attached, vertically opposite each other, which are connected, in each case by means of a clevis 19, to a tensioning cable 20.

Figure 2:
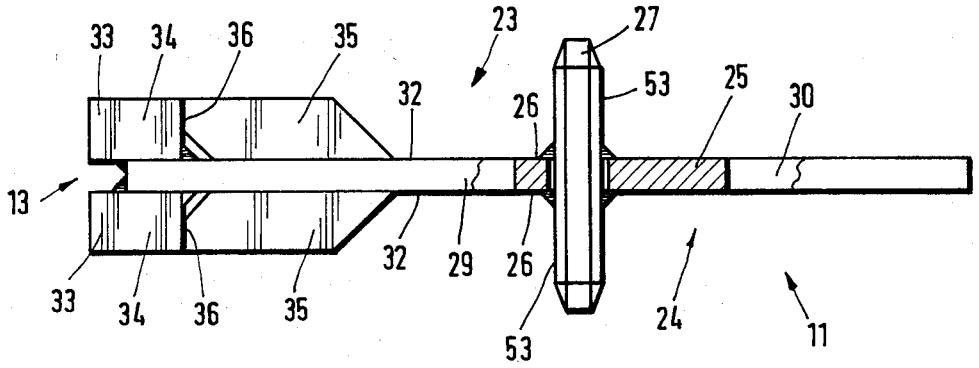
FIG. 2 shows an adjustable coupling, in a view according to FIG. 1, on an enlarged scale.
Figure 3:
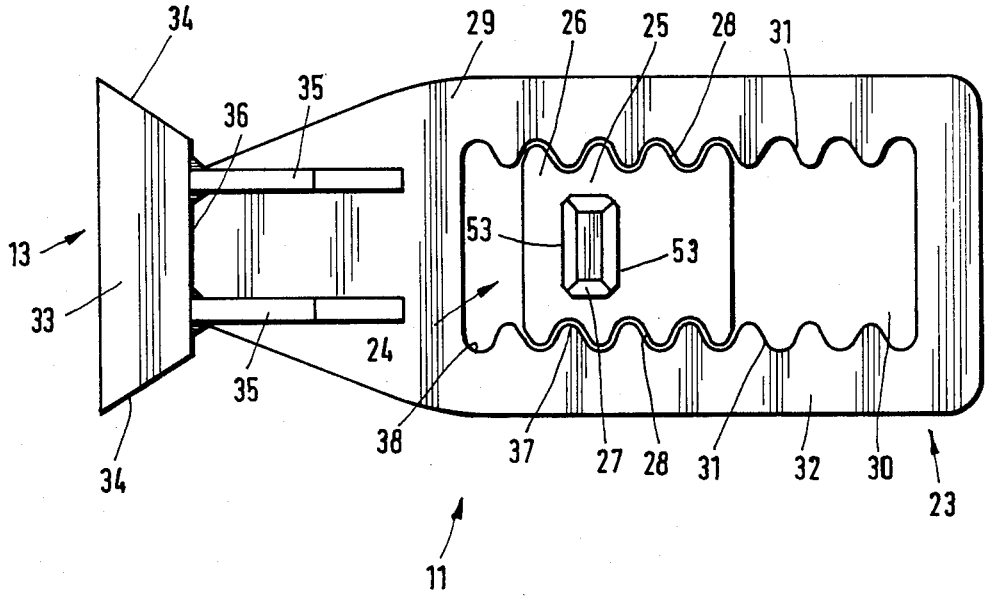
FIG. 3 shows a plan view of the adjustable coupling according to FIG. 2.
Figure 4:
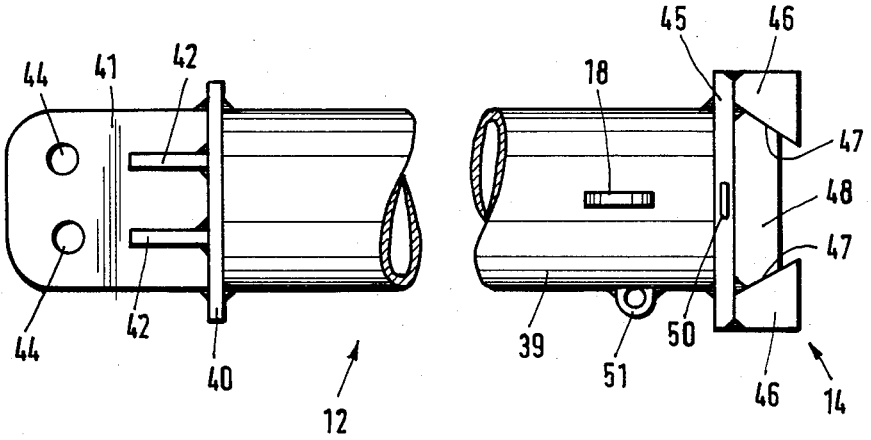
FIG. 4 shows a plan view of a connecting tube of the stowing strut according to FIG. 1, on an enlarged scale.

The connection between two container corner-fittings 21 of two superimposed containers 22 is produced by the adjustable coupling 11, this coupling being connected to the connecting tube 12, which is attached to part of the ship's structure. This coupling is represented in FIGS. 2 and 3, and comprises two parts, namely the coupling plate 23 and a cone-piece 24.

The cone-piece 24 is composed of a plate 25 with two opposite, horizontal bearing surfaces 26, which possess, in each case, an approximately square basal surface. An elongate cone 27, with a rectangular cross-section, is passed vertically through an appropriately dimensioned, out-of-center aperture in the plate 25, in such a manner that the ends of the cone 27 project by the same amount from the two sides of the plate 25. Two edge-areas of the plate 25, running parallel to the two narrow sides of the cross-section of the cone 27, are each provided with a tooth-system or teeth 28. One of the two lateral surfaces 53 of the cone 27 is in approximate alignment with the apex of two oppositely-located projections 37, while the second lateral surface 53 is in alignment with two oppositely-located indentations 38. Depending on the choice of the adjustment-steps desired, the cone 27 can be placed in another position relative to the profile-sections of the tooth-system 28, these positions being referred to the two lateral surfaces 53 of the cone.

The plate 25 and the cone 27 are preferably manufactured from a weldable steel and are welded together to form the cone-piece 24. The cone-piece 24 can likewise be forged from one piece, or cast.

The coupling plate 23 is formed by a plate 29, which has approximately the same thickness as the plate 25, and which is attached to the wedge-piece 13. The plate 29, which is of elongate design, is provided with a rectangular cutout 30, which possesses a tooth-system or teeth 31 on each of its two opposite, longer sides.

The plate 29 of the coupling plate 23 is, in its basal surface, designed with a taper at that end at which the wedge-piece 13 is located, the latter comprising two oppositely-located wedge-bodies 33, which are located, in each case, on one of the two bearing surfaces 32. These wedge-bodies possess, in each case, approximately trapezoidal basal surfaces, and are provided with two guide surfaces 34, which run at an angle to a vertical longitudinal mid-plane of the coupling plate 23, and/or are aligned in such a manner that they increase the basal surface of the wedge-bodies 33 towards one end of the coupling plate 23. The two bearing surfaces 33 possess, in each case, two reinforcements 35, which are joined, in each case, to an end-surface 36 of each wedge-body 33, these end-surfaces standing, in each case, perpendicularly on each bearing surface 32.

The plate 29, the wedge-bodies 33 and the reinforcements 35 are preferably manufactured from steel, and are welded together to produce the coupling plate 23.

The tooth-systems 28, 31 possess a profile, in relation to the bearing surfaces 26, 32, which is composed of projections 37 and indentations 38 with a basal surface which is, in each case, semicircular, these projections and indentations being arranged in successive alternation, one behind the other. For this purpose, the dimensions of the indentations are selected such that they are slightly more generously dimensioned in comparison with the dimensions of the projections 37. The tolerances of the tooth-system 28 on the cone-piece 24, on the one hand, and of the tooth-system 31 on the coupling plate 23, on the other hand, are dimensioned such that these parts freely engage into each other, inside the cutout 30 in the coupling plate 23, in any position of the cone-piece 24. The tooth-system 28 is arranged symmetrically on the two opposite sides of the plate 25. The tooth-systems 28, 31, on the two sides of the plate 25 of the cone-piece 24, and those of the cutout 30 in the coupling plate 23, are, in all cases, located symmetrically opposite each other.

The connecting tube 12 is composed essentially of a tube 39 having a circular cross-section, the fork-piece 15 being located at one of its ends. This fork-piece 15 is composed of a face-plate 40, which is welded in front of the end-surface of the tube 39, possesses a circular basal surface, and has a diameter which is dimensioned so that it projects beyond the outside diameter of the tube 39. Two plates 41, located one above the other with their basal surfaces horizontal, are welded onto the basal surface of the face-plate 40 opposite to the tube 39. Two reinforcements 43 are located between the two plates 41, these reinforcements being welded simultaneously to the face-plate 40 and the two plates 41. A total of four reinforcements 42 are welded into the corners which are formed by the two remaining basal surfaces of the plates 41 and the face-plate 40. Each of the two plates 41 is provided with two through-bores 44, which are located opposite one another in the vertical direction, in alignment, and which are dimensioned in such a manner that the two socket-pins 17 can be pushed through.

The wedge-guide 14 is located at the other end of the tube 39. For this purpose, a face-plate 45, possessing an approximately square cross-section, is welded to the second end-surface of the tube 39. Two (elongate) guide-rails 46 are welded onto the basal side of the face-plate 45 which faces away from the tube 39, in such a manner that they are flush with the edges of the basel surface of the face-plate 45. Each of the two guide-rails 46 possesses a guide surface 47, these guide surfaces being located vertically opposite each other and running, in each case, at an angle to a vertical midplane of the connecting tube 12. The guide surfaces 47, arranged in this manner, form a vertical guide with a trapezoidal cross-section forming a dovetail slot, the dimensions of which are chosen in such a manner that the wedge-piece 13, forming a dovetailing tenon of the adjustable coupling 12, is accommodated therein. The stop-plate 48, which is welded on beneath the guide-rails 46, forms a boundary to the guide surfaces 47.

The entire connecting tube 12 is preferably welded together from a weldable steel.

It is equally possible, instead of coupling together the connecting tube 12 with the adjustable coupling 11 to form the stowing strut 10, to employ, as a stowing strut, merely an adjustable coupling which is provided with one appropriate attachment-end.

I claim:

1. In a stowing strut for lashing containers on board ship, said strut effecting a connecton between said container at a container corner having at least one corner brace, and a component firmly attached to the ship, the improvement wherein said stowing strut (10) consists of a support piece and an interlocking adjustment coupling bracket (23), said coupling bracket (23) consisting of a conical piece (24), a first plate (29) removably receiving said conical piece (24), a releasable coupling means on both ends of the support piece for removably connecting said support piece to said coupling bracket (23) and to said ship's component, said first plate (29) having an elongated longitudinal recess (30) with laterally opposed toothing (31), said conical piece (24) comprising a second plate (25) being of a width corresponding generally to the width of the elongated longitudinal recess of said first plate and having laterally opposed edges bearing corresponding toothing (28) matching said toothing (31) of said first plate (29) and being inserted within said recess via said toothing with said conical piece second plate (25) being substantially smaller lengthwise than said recess (30) such that said conical piece (24) is adjustably positioned longitudinally within said recess (30), said conical piece (24) including a cone (27) for engagement with said at least one container corner brace, and wherein said conical piece cone (27) is arranged on said second plate (25) in an off-center lengthwise direction, such that said conical piece (24) may be rotated 180 degrees while being shifted longitudially relative to said recess (30) wherein various length support pieces may be releasably coupled to said coupling bracket and said ship's component to maximize the adjustability of the container lashing system to rapidly lash various size containers to said ship.

2. The stowing strut according to claim 1, wherein said laterally opposed toothing (31) of said first plate elongated recess (30) and said toothing (28) of said second plate (25) comprise alternating projections and indentations, and wherein said conical piece cone (27) is arranged on said second plate (25) at a lengthwise position such that said cone (27) has opposed lateral surfaces running perpendicular to the lengthwise center plane aligned respectively with a projection and an indentation of said toothing (28), such that reversing said conical piece (24) within the first plate recess (30) in itself causes a further longitudinal shift in position of said cone, improving the adjustability of the stowing strut to the various sized containers.

3. The stowing strut according to claim 1, wherein said support piece comprises a connecting pipe (12) of unvariable length.

4. The stowing strut according to claim 3, wherein said coupling bracket (23) terminates in a wedge-shaped piece (13) and said connecting pipe (12) comprises a wedge guide (14) defining a dovetailed slot receiving said wedge-shaped piece (13) for creating a removable connection between the support piece and said adjustment coupling (11).

5. The stowing strut according to claim 4, further comprising means such that the wedge-shaped piece (13) fits within the wedge guide (14) in a manner whereby the connecting pipe (12) and the adjustment coupling (11) are axially offset from each other.

6. The stowing strut according to claim 5, wherein said wedge guide (14) includes two guide surfaces (47) which are considerably longer than corresponding guide surfaces (34) on the sides of the wedge-shaped piece (13) which are in abutment with the guide surface (47) of the wedge guide.

7. The stowing strut according to claim 4, wherein a chain (49) is attached to the adjustment coupling (11) and terminates in a snap hook, and wherein said connecting pipe (12) includes a holding eye fixed thereto such that the chain (49) when hooked serves to stabilize the wedge-shaped piece (13) in the wedge guide (14).

8. The stowing strut according to claim 4, wherein the wedge guide (14) is provided with a strike plate fixed at the lower end of the wedge guide (14) which limits the guide surfaces (47) thereof.

* * * * *